US012163348B2

(12) United States Patent
Trask

(10) Patent No.: US 12,163,348 B2
(45) Date of Patent: Dec. 10, 2024

(54) SCAFFOLDING STAIR SYSTEM

(71) Applicant: Commercial Scaffolding Companies, Inc., Gardena, CA (US)

(72) Inventor: Jeremy Wayne Trask, Gardena, CA (US)

(73) Assignee: Commercial Scaffolding Companies, Inc., Gardena, CA (US)

( * ) Notice: Subject to any disclaimer, the term of this patent is extended or adjusted under 35 U.S.C. 154(b) by 679 days.

(21) Appl. No.: 17/158,902

(22) Filed: Jan. 26, 2021

(65) Prior Publication Data

US 2022/0235562 A1 Jul. 28, 2022

(51) Int. Cl.
*E04G 5/10* (2006.01)
*E04G 1/17* (2006.01)
*E04G 5/14* (2006.01)

(52) U.S. Cl.
CPC ..... *E04G 5/10* (2013.01); *E04G 1/17* (2013.01); *E04G 5/14* (2013.01)

(58) Field of Classification Search
CPC .. E04G 5/10; E04G 1/17; E04G 27/00; E04G 5/14; E04G 5/16; E04G 1/14
See application file for complete search history.

(56) References Cited

U.S. PATENT DOCUMENTS 2,760,707 A * 8/1956 Anderson ..... E04G 5/10 182/180.1
3,175,654 A * 3/1965 Calvert ..... E04F 11/02 D25/63
3,221,837 A * 12/1965 Fisher ..... E04G 5/10 182/115
3,565,212 A * 2/1971 Johnson ..... E04G 1/154 182/180.1
3,698,511 A * 10/1972 Dohan ..... E04G 1/14 182/119
3,720,024 A * 3/1973 Theisen ..... E04F 11/02 182/115
3,927,518 A * 12/1975 Simmons ..... E04G 27/00 52/127.2

(Continued)

FOREIGN PATENT DOCUMENTS

EP 0713942 A1 * 5/1996
EP 1445399 A2 8/2004

(Continued)

OTHER PUBLICATIONS

"Building Materials Scaffold Ringlock System Aluminium-Stair-Set Scaffolding for Construction" (Accessed Oct. 5, 2020).

(Continued)

*Primary Examiner* — Jessica L Laux
*Assistant Examiner* — Kathleen M. McFarland
(74) *Attorney, Agent, or Firm* — John J. Penny

(57) ABSTRACT

A combined stairway and platform used in scaffolding systems. A stairway and platform system includes a stairway having steps, a top landing platform and a bottom landing platform, wherein the top and bottom landing platforms are integrally formed with the stairway. The top and bottom landing platforms are attachable to a scaffolding frame. An upper and lower end panel, to which a handrail is attached, are configured to attach to the scaffolding frame.

19 Claims, 7 Drawing Sheets

(56) References Cited

U.S. PATENT DOCUMENTS

| | | | | | |
|---|---|---|---|---|---|
| 4,715,474 | A * | 12/1987 | Wehmeyer | E04G 7/306 | 403/268 |
| 5,988,318 | A * | 11/1999 | Krause | E04G 7/305 | 182/186.7 |
| 6,415,891 | B1 * | 7/2002 | Hayman | E04F 11/025 | 182/178.1 |
| 6,691,828 | B1 * | 2/2004 | Hayman | E04F 11/00 | 182/178.1 |
| 8,104,576 | B2 * | 1/2012 | Schwoerer | E04G 5/10 | 182/120 |
| 8,771,544 | B2 * | 7/2014 | Hopper | E04G 27/00 | 252/185 |
| 10,047,559 | B2 * | 8/2018 | Johansson | E06C 1/397 | |
| 10,358,871 | B2 * | 7/2019 | Honeycutt | E04G 7/02 | |
| 10,532,827 | B2 * | 1/2020 | Springer | E06C 1/383 | |
| 10,640,983 | B2 * | 5/2020 | Honeycutt | E04G 27/00 | |
| 2009/0100614 | A1 * | 4/2009 | Dale | B63B 27/14 | 14/71.3 |
| 2009/0205906 | A1 * | 8/2009 | Schwoerer | E04F 11/112 | 182/92 |
| 2010/0293875 | A1 * | 11/2010 | Preston | E04G 27/00 | 52/183 |
| 2011/0079465 | A1 * | 4/2011 | Karanouh | E04G 27/00 | 182/115 |
| 2011/0088973 | A1 * | 4/2011 | Shih | E04G 5/10 | 182/115 |
| 2011/0271613 | A1 * | 11/2011 | Hopper | F03D 80/80 | 52/185 |
| 2017/0275888 | A1 * | 9/2017 | Honeycutt | E04F 11/025 | |
| 2018/0066474 | A1 * | 3/2018 | Johansson | E06C 1/04 | |
| 2018/0346149 | A1 * | 12/2018 | Springer | E06C 5/04 | |
| 2019/0040637 | A1 * | 2/2019 | Ahto | E04G 5/046 | |
| 2020/0407984 | A1 * | 12/2020 | Hellenschmidt | E06C 7/082 | |

FOREIGN PATENT DOCUMENTS

| | | | | |
|---|---|---|---|---|
| EP | 2031150 | A2 | 3/2009 | |
| EP | 3628794 | A1 | 4/2020 | |
| FR | 2644497 | A1 | 3/1989 | |
| GB | 2207177 | A * | 1/1989 | E04G 5/10 |

OTHER PUBLICATIONS

"Layher SpeedyScaf System" Building Materials Scaffold Ringlock System Aluminium-Stair-Set Scaffolding for Construction (Nov. 15, 2012).

"Sectional Scaffolding Product Selection Guide" Brand Safway; p. 17; (2018).

* cited by examiner

SCAFFOLDING STAIR SYSTEM

FIELD OF USE

This present invention relates generally to scaffolding systems in the construction industry. Specifically, the invention relates to a novel combined stairway and platform for use with scaffolding systems, and a scaffolding system comprising the same.

BACKGROUND

It is common to use scaffolding in the construction of buildings in order to provide access to the building for the construction workers and materials and to perform the construction tasks. However, many scaffolding systems and designs require many components and as a result lots of time is needed to set up and break down. Setting up, maintaining and breaking down scaffolding accounts for a significant portion of the construction time and costs. Providing stair access to scaffolds is not a common installation element for many scaffold systems because the time and cost required to assemble the stair access, as compared to standard ladder access for scaffolds. Further, the improper assembly of scaffolding and scaffolding access can cause accidents that can further increase the cost.

SUMMARY

A stairway and platform system comprising a stairway having steps, a top landing platform and a bottom landing platform, wherein the top and bottom landing platforms are integrally formed with the stairway and are attachable to a scaffolding frame. A handrail is attached to the stairway. An upper and lower end panel, to which the handrail is attached, are configured to attach to the scaffolding frame.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The invention will be more fully understood by reference to the detailed description, in conjunction with the following figures, wherein.

DETAILED DESCRIPTION

Figure 1:
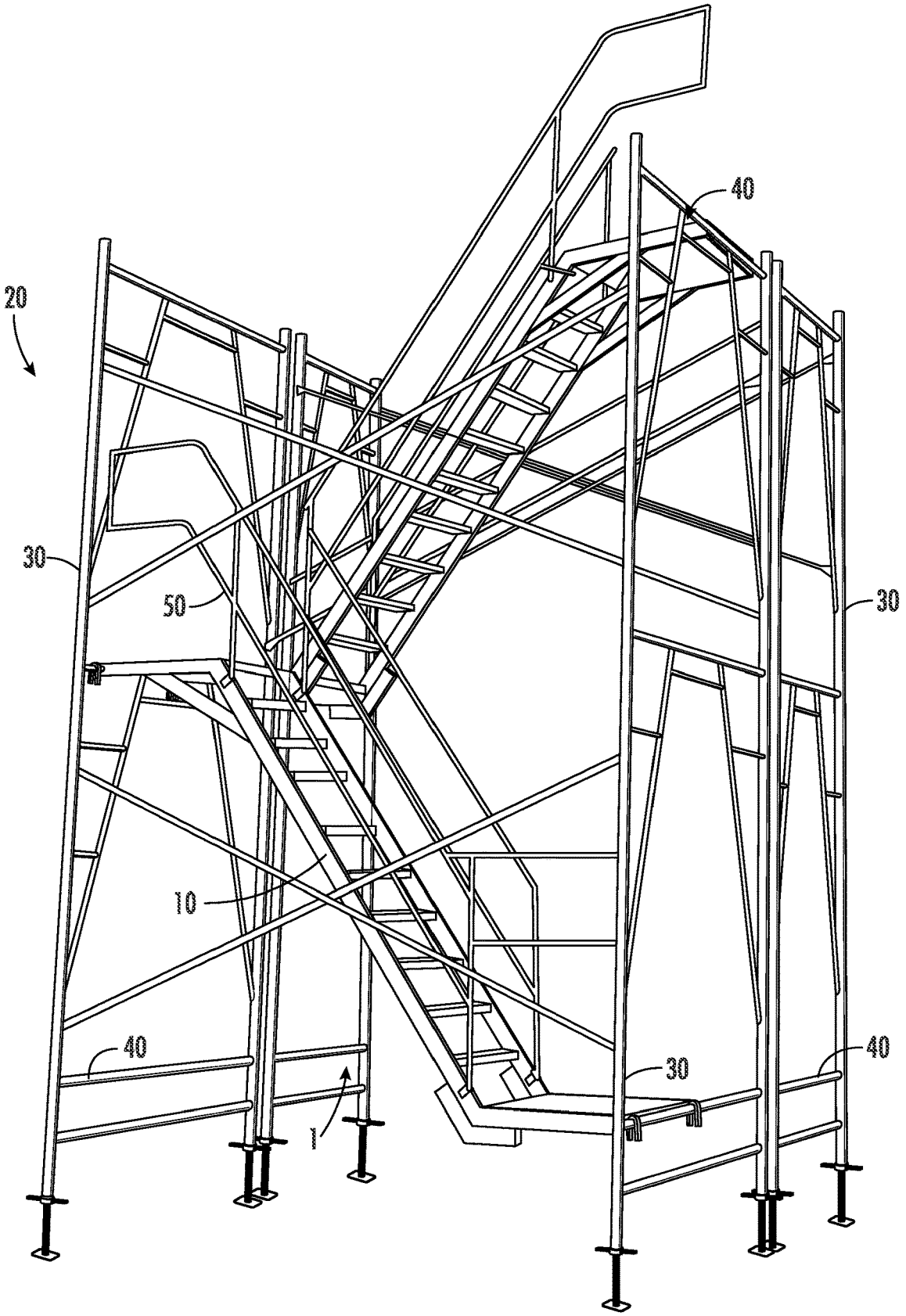
FIG. 1 shows a stairway and platform system installed in a scaffolding frame.

The subject innovation is now described with reference to the drawings, wherein like reference numerals are used to refer to like elements throughout. In the following description, for purposes of explanation, numerals specific details are set forth in order to provide a thorough understanding of the present invention. It may be evident, however, that the present invention may be practiced without these specific details.

An exemplary embodiment of the present invention is shown in FIG. 1. As shown in FIG. 1, the stairway and platform system 1 comprises a stairway 10 that is attachable to the scaffolding frame 20. The scaffolding frame 20 can comprise vertical supports 30 and horizontal web bracings 40 that spans between the vertical supports 30. A handrail 50 is attached to the stairway 10 to provide safety handrails for the user and to provide a way to attach the stairway 10 to the scaffolding frame 20. The scaffolding frame shown in FIG. 1 is just one example of a scaffolding frame. The present invention can be applied to any common/typical scaffolding frame.

Figure 2:
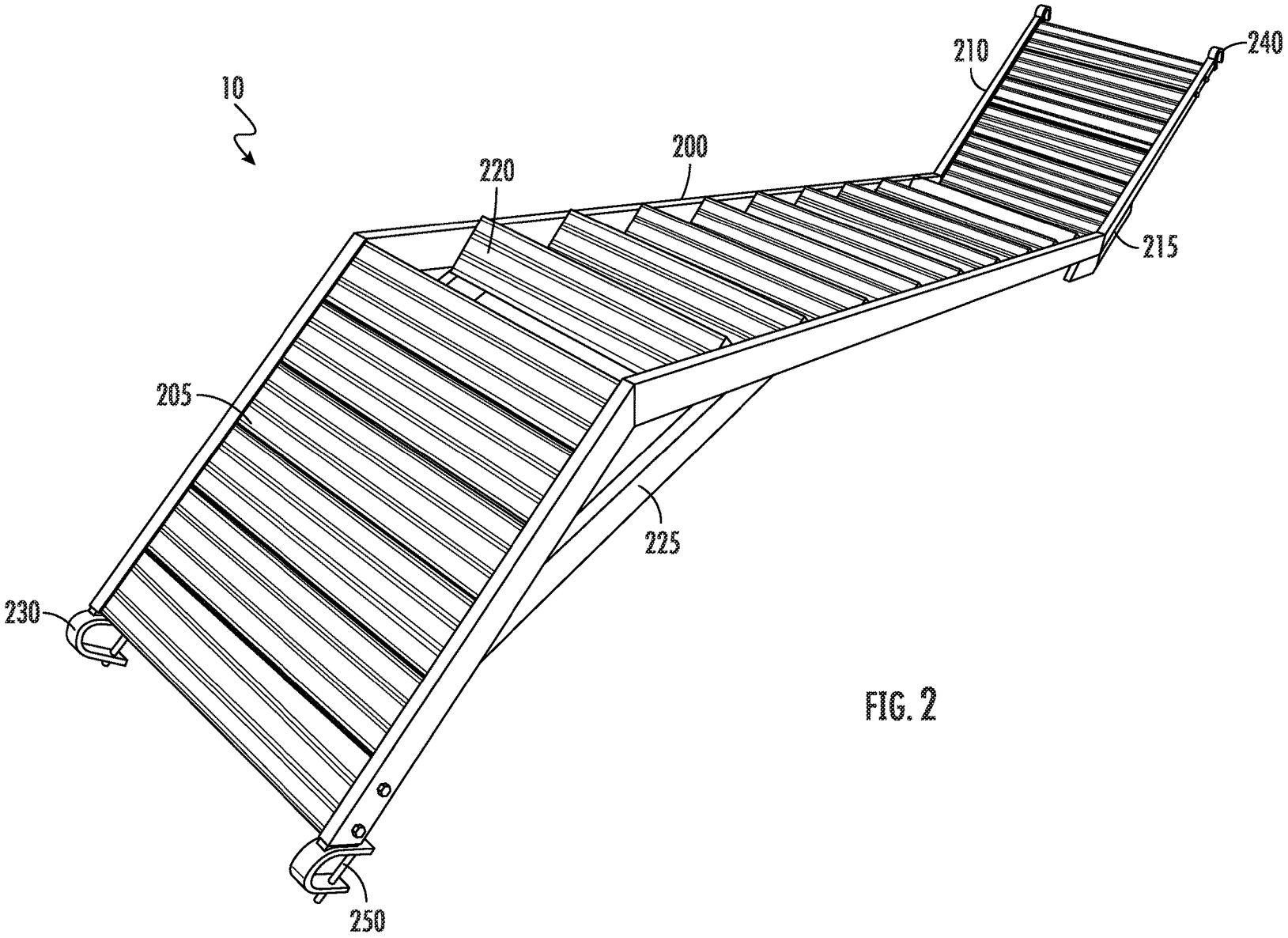
FIG. 2 shows a stairway of a stairway and platform system.

As shown in FIG. 2, the stairway 10 includes a stairway portion 200. As shown in FIG. 2, the stairway portion 200 is integrally formed with top landing platform 205 at the top of the stairway portion 200 and a bottom landing platform 210 at the bottom of the stairway portion 200. The top and bottom landing platforms 205, 210 can be attached to the stairway portion 200 by welding, fasteners, or other means. By making the top and bottom landing platforms integral with the stairway portion, the system becomes much simpler and easier to set up and take down.

Figure 4:
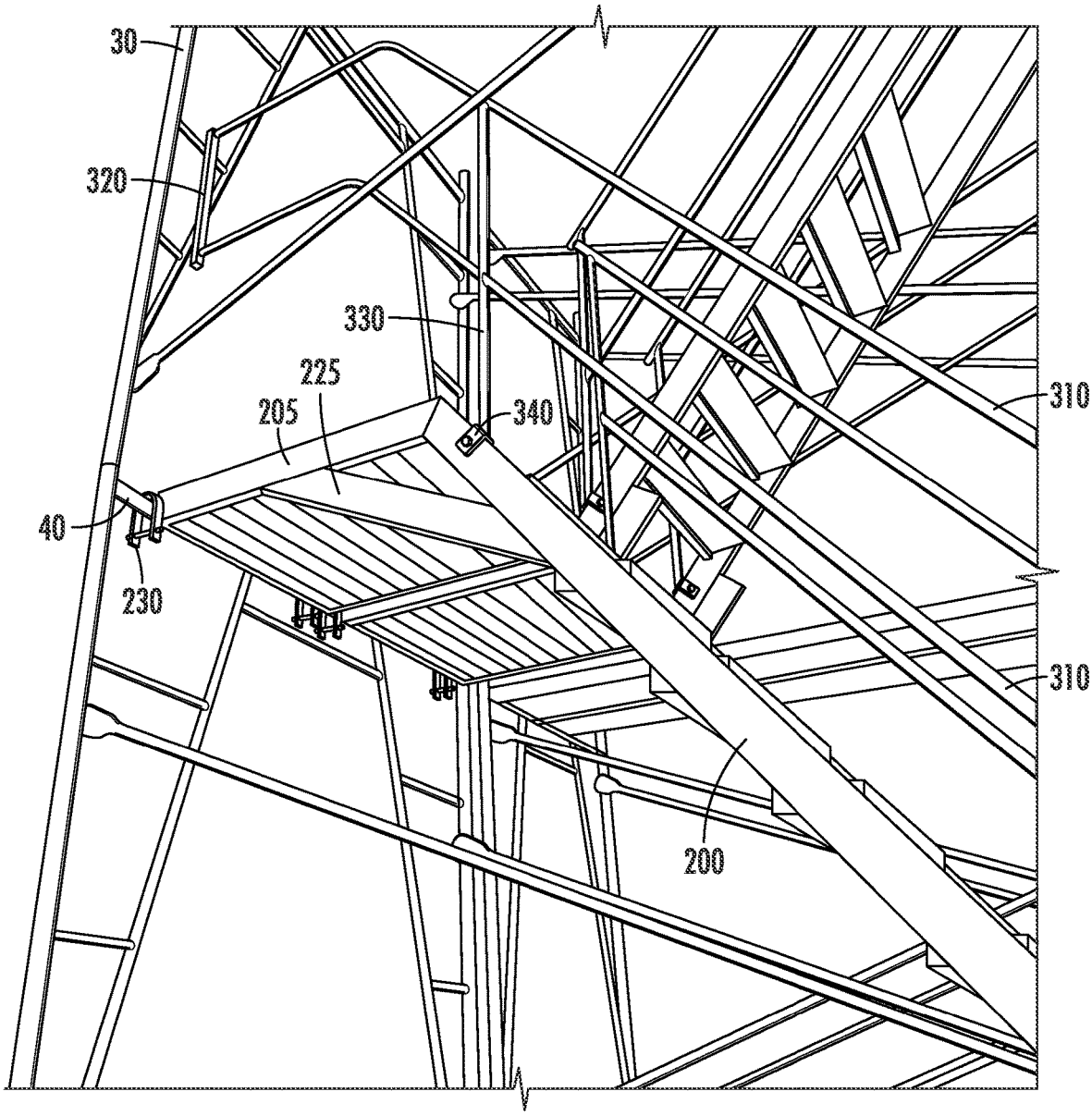
FIG. 4 shows a top portion of a stairway mounted to a scaffolding frame.
Figure 5:
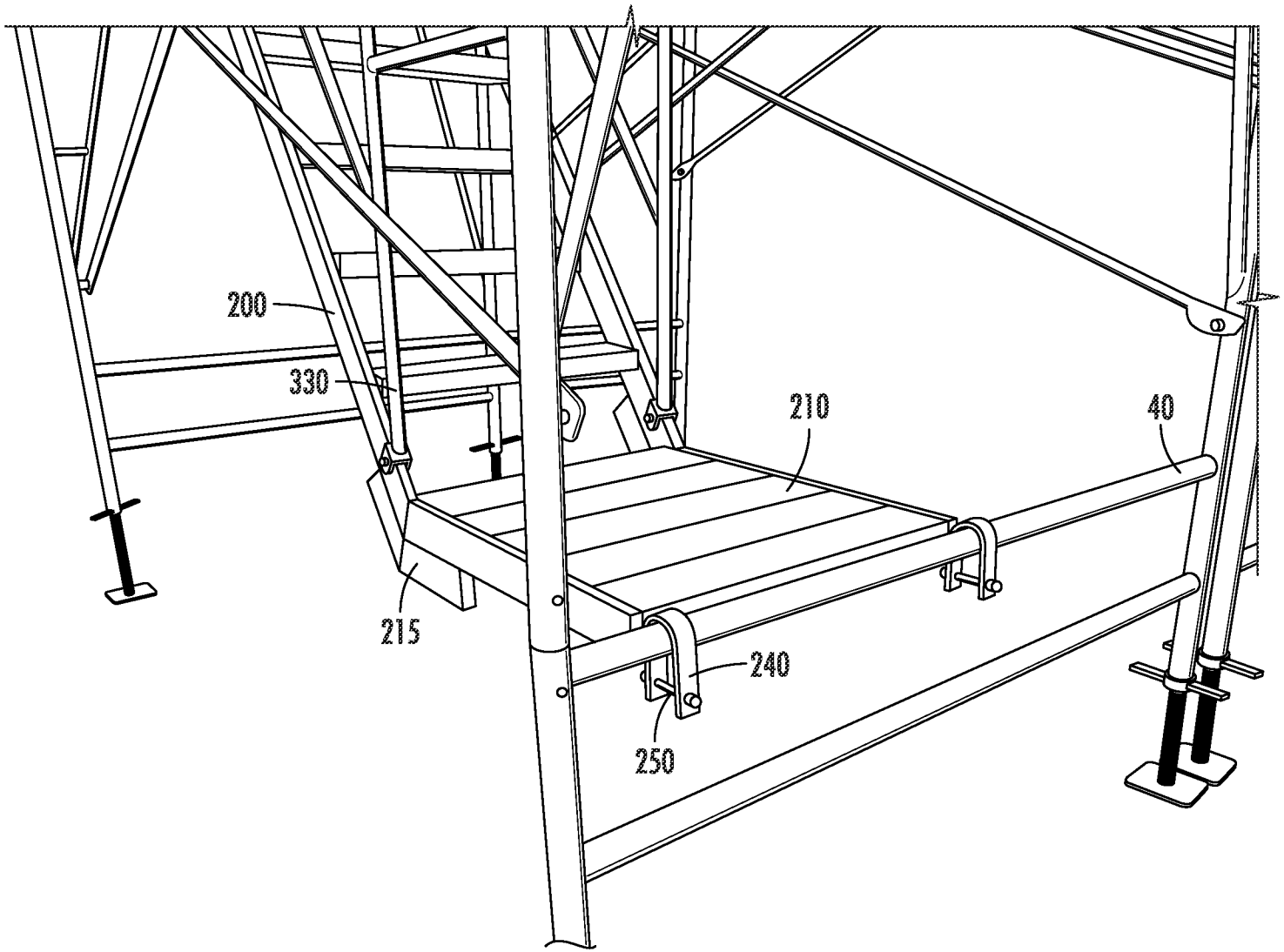
FIG. 5 shows a bottom portion of a stairway mounted to a scaffolding frame.

As shown in FIG. 2, a reinforcing brace 215 can be used to further connect the stairway portion 200 to the bottom landing platform 210. A cross brace 225 can be used to further connect the stairway portion 200 to the top landing platform 205. This cross brace 225 and reinforcing brace 215 can be fixed to the stairway portion 200 and the top and bottom landing platforms 205, 210 by welding, bolting other similar means. The top and bottom landing platforms 205, 210 can include U-shaped brackets 230, 240 for fastening the top and bottom landing platforms 205, 210 to the scaffolding frame 20. Specifically, the U-shaped brackets 230, 240 can be fixed to the scaffolding frame 20 by hooking them over the horizontal web bracing 40 of the scaffolding frame 20 and fastening a bolt 250 through the U-shaped bracket, as shown in FIGS. 4 and 5. These U-shaped brackets make it possible to easily connect the stairway 10 to the scaffolding frame 20. Also, because the stairway portion 200 is integrally formed with top and bottom landing platforms 205, 210, the stairway 10 performs not only a stair function, but also acts as structure to absorb the scaffolding loads.

The stairway portion 200 also comprises steps 220 that form the steps of the stairway portion 200. The steps 220 can be integrally attached to the stairway portion 200 by welding or other similar means. This eliminates the necessity of attaching the steps 220 to the stairway at the job site. The steps 220 can be spaced approximately 8 inches apart and can have a depth of approximately 5 inches.

Figure 3:
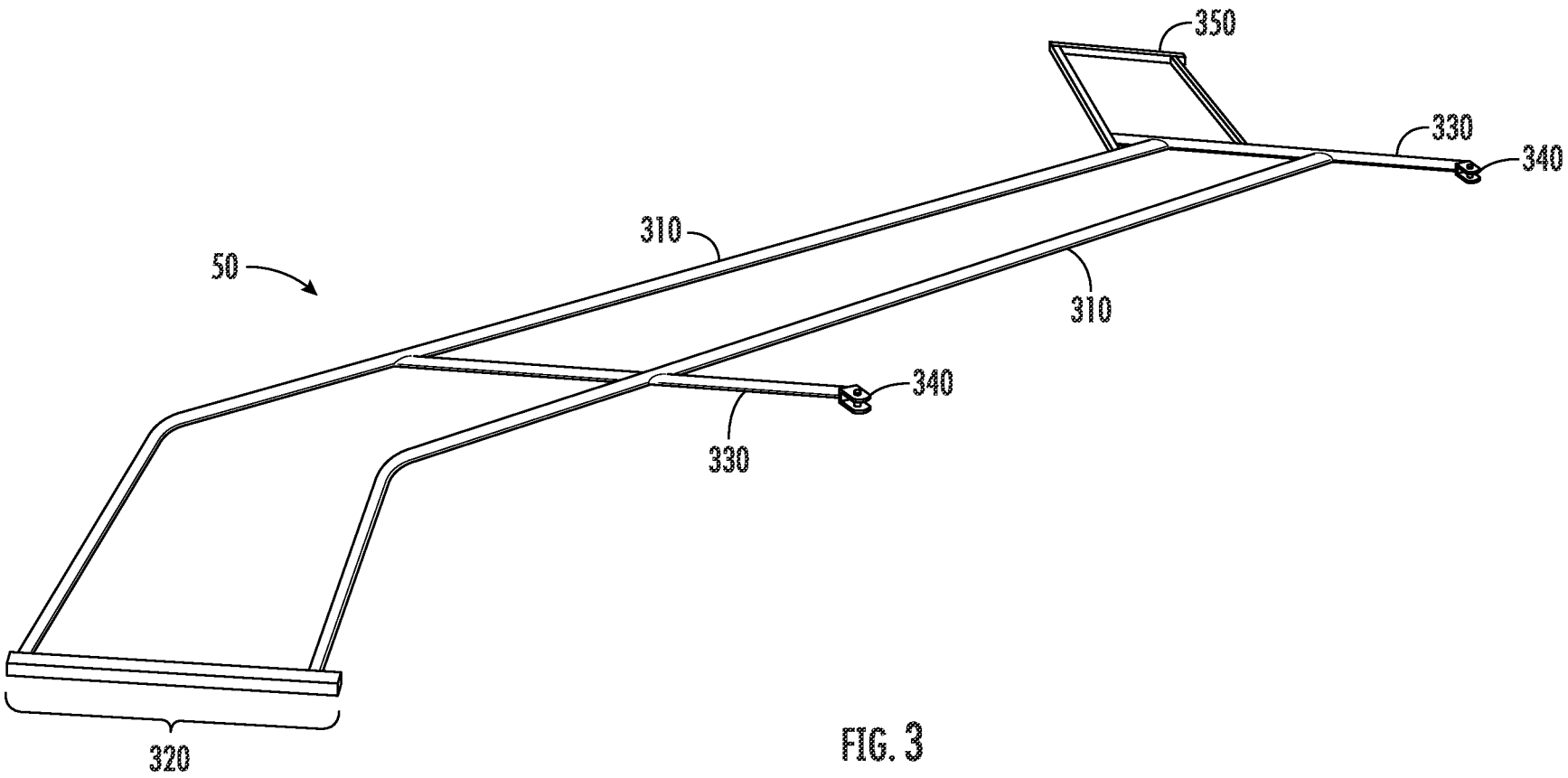
FIG. 3 shows a handrail of a stairway and platform system.

As shown in FIG. 1, the handrail 50 is attached to the stairway 10 to provide safety handrails for the user and to provide a way to attach the stairway 10 to the scaffolding system. As shown in FIG. 3, the handrail 50 includes inclined sections 310 that are approximately parallel to the stairway portion 200 of the stairway 10, an upper section 320 that extends above the top landing platform 205 and a lower section 350 that extends above the bottom landing platform 210. Two (2) vertical sections 330 intersect the inclined sections 310 and attach to the stairway 10. Although two (2) vertical sections 330 and two (2) inclined sections 310 are shown in FIG. 3, any number of vertical sections and inclined sections can be used. The bottom ends of the vertical sections 330 of the handrail 50 can include a U-shaped bracket 340 that can be fixed to the stairway 10 using fasteners such as a bolt that extends through the stairway portion 200, as shown in FIG. 4. Any other suitable arrangements could be used to attach the handrail 50 to the stairway 10.

Figure 6:
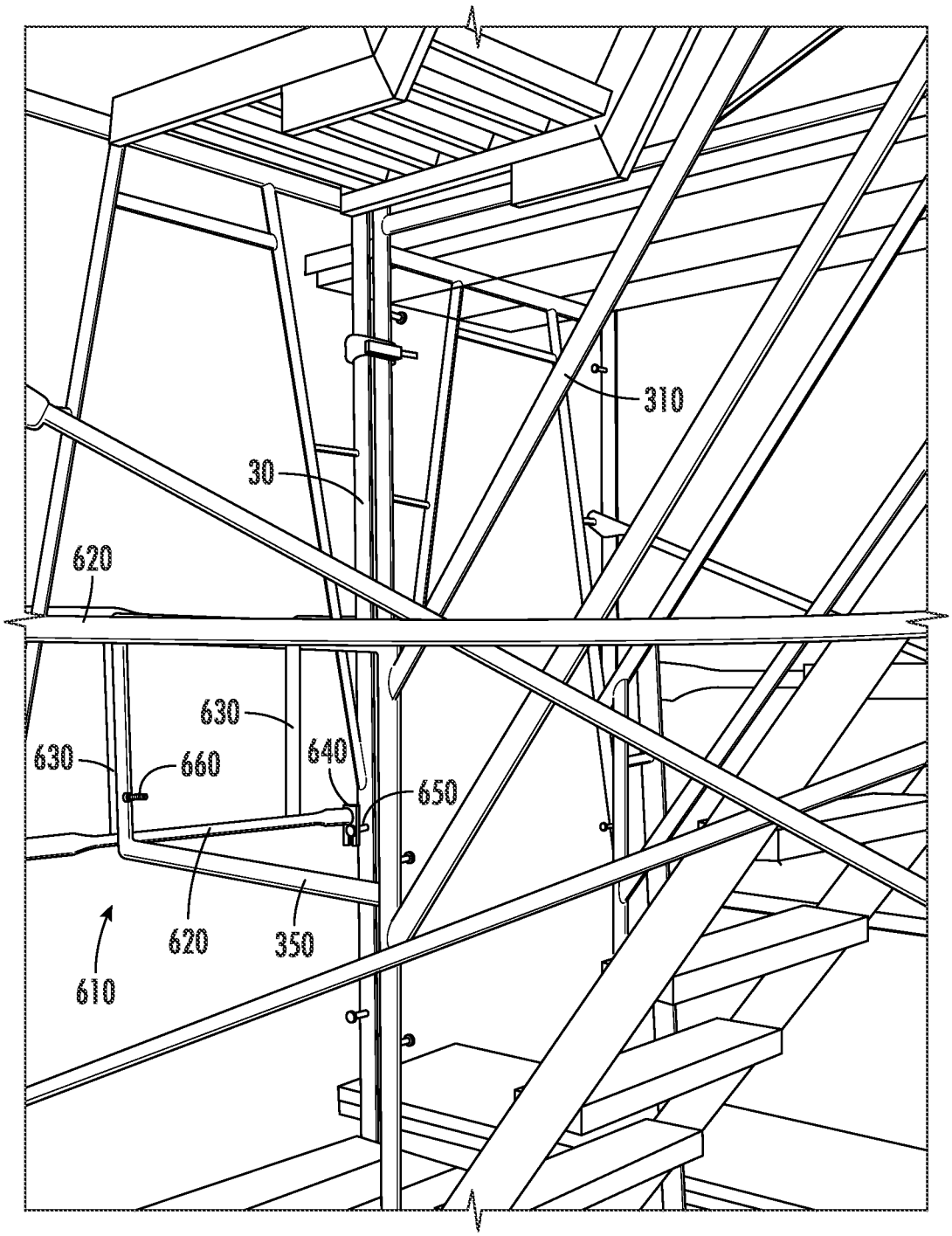
FIG. 6 shows a lower end panel attached to a lower section of a handrail.

The stairway and platform system 1 further comprises a lower end panel 610 to which the lower section 350 of the handrail 50 is mounted, as shown in FIG. 6. The lower end panel 610 can be attached to the lower section 350 of the handrail 50 with bolts or a quick drop pin. FIG. 6 shows a ½"×3" galvanized bolt 660 that is used to connect the lower end panel 610 to the lower section 350 of the handrail 50. Other types of bolts can be used. The lower end panel 610 is mounted to a vertical support 30 in the scaffolding frame 20. As shown in FIG. 6, the lower end panel 610 can comprise horizontal sections 620 and vertical sections 630. The end panel 610 can have any design that allows it to have a rigid structure, such as a truss configuration. The ends of the horizontal sections 620 can comprise U-shaped hooks 640 that fit into protrusions 650 formed on the vertical supports 30 of the scaffolding frame 20. The end panel 610 can be attached to the scaffolding frame 20 in any way that creates a rigid connection between the lower end panel 610 and the scaffolding frame 20. For example, the lower end panel 610 could-be attached to the vertical supports 30 of the scaffolding frame 20 using mounting brackets. Fixing the handrail 50 to the stairway 10 and fixing the handrail 50 to the end panels 610, 710, which are both fixed to the scaffolding frame 20, create a rigid connection between the scaffolding frame 20 and the stairway and platform system 1 such that the stairway and platform system 1 becomes structurally part of the scaffolding, thereby strengthening the scaffolding frame 20.

Figure 7:
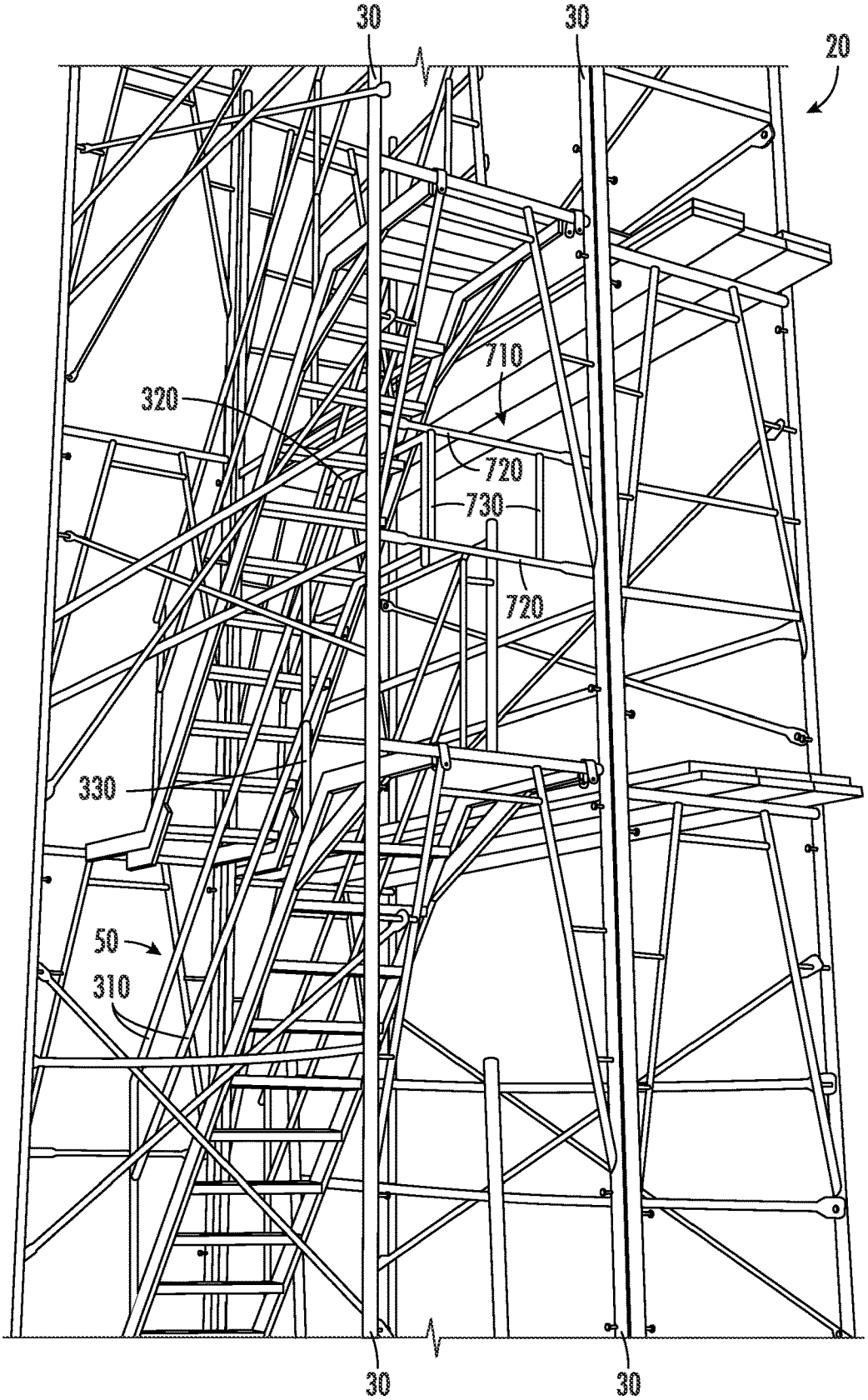
FIG. 7 shows an upper end panel attached to an upper section of a handrail.

The upper section 320 of the handrail 50 can be attached to the scaffolding frame 20 in a similar manner. As shown in FIG. 7, an upper end panel 710 is attached to the upper section 320 of the handrail 50. The upper end panel 710 can be attached to the upper section 320 of the handrail 50 with bolts or a quick drop pin (not shown), as shown in FIG. 6 for the lower end panel 610. The upper end panel 710 is mounted to a vertical support 30 in the scaffolding frame 20. As shown in FIG. 7, the upper end panel 710 can comprise horizontal sections 720 and vertical sections 730. The end panel 710 can have any design that allows it to have a rigid structure, such as a truss configuration. The ends of the horizontal sections 720 can comprise U-shaped hooks 740 (not shown) that fit into protrusions 650 (not shown) formed on the vertical supports 30 of the scaffolding frame 20, as shown in FIG. 6 for the lower end panel 610. The end panel 710 also can be attached to the scaffolding frame 20 in any way that creates a rigid connection between the upper end panel 710 and the scaffolding frame 20, as presented above.

The above-described stairway and platform system comprising a stairway 10 integrally formed with top and bottom landing platforms 205, 210, which are fixed to the scaffolding frame 20, can provide diagonal support between the vertical supports 30 of the scaffolding frame 20. Also, having the handrail 50 attached to the stairway 10 and attached to the scaffolding frame 20 through the end panels 610, 710 (see FIGS. 6 and 7) further absorbs the diagonal scaffolding loads. This design allows the stairway and platform system to become a structural part of the scaffolding system that provides strength and stability to the scaffolding system. Therefore, the normal diagonal cross braces between the vertical supports of the scaffolding frame 20 may not be necessary, and the same strength can be maintained. Since these diagonal cross-braces generally are used on each side of the scaffolding throughout the height of the scaffolding, eliminating the cross-bracing substantially reduces the materials required for the scaffolding, which saves a lot of money. Also, the construction and deconstruction of the scaffolding at the construction site becomes easier and faster, which also saves time and money Eliminating these diagonal cross-braces saves a lot of time and money when constructing the scaffolding at a site and taking it down.

So, the integrated stairs and top and bottom platforms perform not only the stair function, but also act as structure to absorb the diagonal scaffolding loads. By making the stair platforms integral with the stairs, the scaffolding design becomes much simpler and easier to set up and take down. Also, the steps are welded to the stairway. In many prior systems, the steps have to be attached to the stairway at the job site. Also, the combined stairway and platform can be easily fastened to standard scaffolding using U-shaped connections, as presented above.

The stairway and platform system described herein can be implemented in any scaffolding system and using any dimensions. For example, the stairway and platform system can be used in 3'×10' or 5'×10' scaffolding bay, or any other size. Also, the scaffold and platform system described herein can be used with other fabricated frames, system style or tube and clamp scaffolds. Further, the system can be used as a system to access scaffold work levels or as a stand-alone unit to provide access to buildings or structures under renovation, independent from any conventional scaffold system.

It should be understood that the invention is not limited by the specific embodiments described herein, which are offered by way of example and not by way of limitation. Variations and modifications of the above-described embodiments and its various aspects will be apparent to one skilled in the art and fall within the scope of the invention, as set forth in the following claims. For example, various materials, dimensions, fasteners, and connections could be used in the stairway and platform system without departing from the scope of the invention.

What is claimed is:

1. A stairway and platform system comprising:

a stairway comprising steps, a top landing platform and a bottom landing platform, wherein the top and bottom landing platforms are integrally formed with the stairway, the top and bottom landing platforms are attachable to a scaffolding frame, and the top and bottom landing platforms include U-shaped brackets that are attachable to the scaffolding frame;

a handrail attached directly to the stairway, wherein the handrail comprises an upper section that is configured to extend above the top landing platform, and a lower section that is configured to extend above the bottom landing platform;

a lower end panel to which the lower section of the handrail is attached, the lower end panel being configured to attach to the scaffolding frame, wherein the lower end panel extends between vertical supports of the scaffolding frame; and an upper end panel to which the upper section of the handrail is attached, the upper end panel being configured to attach to the scaffolding frame, wherein the upper end panel extends between the vertical supports of the scaffolding frame, the lower end panel and upper end panel comprise at least two horizontal sections that extend between the vertical supports of the scaffolding frame, and the upper and lower end panels have U-shaped hooks at ends thereof that are configured to fit into protrusions formed on the scaffolding frame.

2. The stairway and platform system of claim 1, wherein the U-shaped brackets are configured to hook over a horizontal web bracing of the scaffolding frame.

3. The stairway and platform system of claim 1, wherein the protrusions are formed on vertical supports of the scaffolding frame.

4. The system of claim 1, wherein the upper and lower end panels comprise vertical sections, the U-shaped hooks being formed on one of the at least two horizontal sections.

5. The system of claim 1, wherein the steps are integrally attached to the stairway.

6. The system of claim 1, further comprising a reinforcing brace that connects the stairway portion to the bottom landing platform.

7. The system of claim 1, further comprising a cross brace that connects the stairway portion to the top landing platform.

8. A stairway and platform system comprising:

a stairway comprising steps, a top landing platform and a bottom landing platform, wherein the top and bottom landing platforms are integrally formed with the stairway, the top and bottom landing platforms are attachable to a scaffolding frame;

a handrail attached directly to the stairway, wherein the handrail comprises an upper section that is configured to extend above the top landing platform, and a lower section that is configured to extend above the bottom landing platform;

a lower end panel to which the lower section of the handrail is attached, the lower end panel being configured to attach to the scaffolding frame, wherein the lower end panel extends between vertical supports of the scaffolding frame; and an upper end panel to which the upper section of the handrail is attached, the upper end panel being configured to attach to the scaffolding frame, wherein the upper end panel extends between the vertical supports of the scaffolding frame, and the lower end panel and upper end panel comprise at least two horizontal sections that extend between the vertical supports of the scaffolding frame, wherein the upper and lower end panels have U-shaped hooks at ends thereof that are configured to fit into protrusions formed on the scaffolding frame.

9. A stairway and platform system comprising:

a stairway comprising steps, a top landing platform and a bottom landing platform, wherein the top and bottom landing platforms are integrally formed with the stairway, the top and bottom landing platforms are attachable to a scaffolding frame;

a handrail attached directly to the stairway, wherein the handrail comprises an upper section that is configured to extend above the top landing platform, and a lower section that is configured to extend above the bottom landing platform;

a lower end panel to which the lower section of the handrail is attached, the lower end panel being configured to attach to the scaffolding frame, wherein the lower end panel extends between vertical supports of the scaffolding frame; and an upper end panel to which the upper section of the handrail is attached, the upper end panel being configured to attach to the scaffolding frame, wherein the upper end panel extends between the vertical supports of the scaffolding frame, and the lower end panel and upper end panel comprise at least two horizontal sections that extend between the vertical supports of the scaffolding frame, wherein bottom ends of the handrail comprise a U-shaped bracket configured to fix the handrail to the stairway using fastener that extends through the U-shaped bracket and the stairway portion.

10. A stairway and platform system comprising:

a stairway comprising steps, a top landing platform and a bottom landing platform, wherein the top and bottom landing platforms are integrally formed with the stairway, the top and bottom landing platforms are attachable to a scaffolding frame, and the top and bottom landing platforms include U-shaped brackets that are attachable to the scaffolding frame;

a handrail attached directly to the stairway;

a lower end panel to which the handrail is attached, the lower end panel being configured to attach to the scaffolding frame, wherein the lower end panel extends between vertical supports of the scaffolding frame; and an upper end panel to which the handrail is attached, the upper end panel being configured to attach to the scaffolding frame, wherein the upper end panel extends between the vertical supports of the scaffolding frame, the lower end panel and upper end panel comprise at least two horizontal sections that extend between the vertical supports of the scaffolding frame, and the upper and lower end panels have U-shaped hooks at ends thereof that are configured to fit into protrusions formed on the scaffolding frame.

11. The stairway and platform system of claim 10, wherein the U-shaped brackets are configured to hook over a horizontal web bracing of the scaffolding frame.

12. The stairway and platform system of claim 10, wherein the protrusions are formed on vertical supports of the scaffolding frame.

13. The system of claim 10, wherein the upper and lower end panels comprise vertical sections, the U-shaped hooks being formed on one of the at least two horizontal section sections.

14. The system of claim 10, wherein the steps are integrally attached to the stairway.

15. The system of claim 10, further comprising a reinforcing brace that connects the stairway portion to the bottom landing platform.

16. The system of claim 10, further comprising a cross brace that connects the stairway portion to the top landing platform.

17. A stairway and platform system comprising:

a stairway comprising steps, a top landing platform and a bottom landing platform, wherein the top and bottom landing platforms are integrally formed with the stairway, and the top and bottom landing platforms are attachable to a scaffolding frame;

a handrail attached directly to the stairway;

a lower end panel to which the handrail is attached, the lower end panel being configured to attach to the scaffolding frame, wherein the lower end panel extends between vertical supports of the scaffolding frame; and an upper end panel to which the handrail is attached, the upper end panel being configured to attach to the scaffolding frame, wherein the upper end panel extends between the vertical supports of the scaffolding frame, and the lower end panel and upper end panel comprise at least two horizontal sections that extend between the vertical supports of the scaffolding frame, wherein the upper and lower end panels have U-shaped hooks at ends thereof that are configured to fit into protrusions formed on the scaffolding frame.

18. A stairway and platform system comprising:

a stairway comprising steps, a top landing platform and a bottom landing platform, wherein the top and bottom landing platforms are integrally formed with the stairway, and the top and bottom landing platforms are attachable to a scaffolding frame;

a handrail attached directly to the stairway;

a lower end panel to which the handrail is attached, the lower end panel being configured to attach to the scaffolding frame, wherein the lower end panel extends between vertical supports of the scaffolding frame; and an upper end panel to which the handrail is attached, the upper end panel being configured to attach to the scaffolding frame, wherein the upper end panel extends between the vertical supports of the scaffolding frame, and the lower end panel and upper end panel comprise at least two horizontal sections that extend between the vertical supports of the scaffolding frame, wherein bottom ends of the handrail comprise a U-shaped bracket configured to fix the handrail to the stairway using fastener that extends through the U-shaped bracket and the stairway portion.

19. A stairway and platform system comprising:

a stairway comprising steps, a top landing platform and a bottom landing platform, wherein the top and bottom landing platforms are integrally formed with the stairway, and the top and bottom landing platforms are attachable to a scaffolding frame, and the top and bottom landing platforms include U-shaped brackets that are attachable to the scaffolding frame;

a handrail attached directly to the stairway, wherein the handrail comprises an upper section that is configured to extend above the top landing platform, and a lower section that is configured to extend above the bottom landing platform, wherein the lower section of handrail is attached to a vertical section of the lower end panel;

a lower end panel to which the lower section of the handrail is attached, the lower end panel being configured to attach to the scaffolding frame, wherein the lower end panel extends between vertical supports of the scaffolding frame; and an upper end panel to which the upper section of the handrail is attached, the upper end panel being configured to attach to the scaffolding frame, wherein the upper end panel extends between the vertical supports of the scaffolding frame, and the lower end panel and upper end panel comprise at least two horizontal sections that extend between the vertical supports of the scaffolding frame, wherein the vertical section of the lower end panel is located in a central portion of the lower end panel.

* * * * *